US005371904A

United States Patent [19]

McEwen

[11] Patent Number: 5,371,904

[45] Date of Patent: Dec. 13, 1994

[54] COLLAR CONSTRUCTION

[75] Inventor: John C. McEwen, Mocksville, N.C.

[73] Assignee: Sara Lee Corporation, Winston-Salem, N.C.

[21] Appl. No.: 10,640

[22] Filed: Jan. 28, 1993

[51] Int. Cl.[5] ..... A41B 1/12; A41B 3/00; A41B 5/00; A41D 27/18

[52] U.S. Cl. ..... 2/129; 2/131; 2/113

[58] Field of Search ..... 2/105, 106, 113, 114, 2/115, 243 R, 243 A, 243 B, 97, 244, 129, 131, 132, 133, 134, 135, 137, 136, 139, 140, 141.1, 141.2, 142, 143; 112/426, 440

[56] References Cited

U.S. PATENT DOCUMENTS

| | | | |
|---|---|---|---|
| 1,554,860 | 9/1925 | Leopold | 2/274 |
| 1,774,577 | 9/1930 | Weinstein | 2/97 |
| 3,399,642 | 9/1968 | Etchison et al. | 2/275 |
| 3,474,465 | 10/1969 | Artzt | 2/113 |
| 5,070,542 | 12/1991 | LaVelle . | |

FOREIGN PATENT DOCUMENTS

| | | | |
|---|---|---|---|
| 2095976 | 10/1982 | United Kingdom | 2/275 |

*Primary Examiner*—Jeanette E. Chapman
*Attorney, Agent, or Firm*—Rhodes, Coats & Bennett

[57] ABSTRACT

An edge construction for a garment. The construction includes a garment body provided with a finished lower edge and sleeves suitably attached opposite side of the upper end of the garment body. The body is cut away in the usual manner at its upper extremity to form a neck opening. The upper edge portion of the body portion is folded inwardly to form a first fold. A strip of collarette fabric material is formed into a longitudinally extending second fold therein to form inner and outer layers. The inner and outer layers are disposed on the inner face of the body portion so as to have the second fold lie substantially parallel to the folded edge of the body portion. The lower edge portion of the outer layer is folded inwardly upon itself so as to form a third fold extending substantially parallel to the first and second folds. At least two rows of substantially parallel stitching fix the strip of fabric material to the fabric body portion. Because both the edges of the fabric body and the collarette fabric strip are folded inwardly, no raw edges show. The resulting construction is durable, has a natural tendency to lay flat, and provides an attractive finish in the neck of the garment.

5 Claims, 2 Drawing Sheets

COLLAR CONSTRUCTION

BACKGROUND OF THE INVENTION (1) Field of the Invention

The present invention relates generally to knitted garment construction and, more particularly, to a collarette construction for the neck and sleeve openings of knitted garments of the slip-over type commonly referred to as T-shirts.

(2) Description of the Prior Art

In the manufacture of T-shirts and related slip-over garments, it is common practice to form the body of the garment from a section of knitted tubular material. A neck opening is cut in the material and this opening is finished by applying to the body of the garment what is normally referred to as a "collarette." The collarette is ordinarily made of a 1×1 rib knit material, the material being passed through a folding machine and doubled back upon itself to provide two layers before being applied to the garment.

As applied to the garment the two layers are disposed on opposite sides of the garment body material, and the free edge of the outer layer is turned under and stitched to the garment so as not to leave a raw edge outwardly of the garment. The lower edge of the inner layer is commonly left with a raw edge. In the past, this inner raw edge is substantially covered by a coverseaming stitch, such as a 406 coverseaming stitch, which attaches the collarette to the garment body.

Such constructions lack a highly desirable finished tailored look. Specifically, the neck line of the garment, when viewed from the outside thereof, does not provide an attractive finish. In addition, such constructions either do not have a natural tenency to lay flat or require additional steps in the manufacturing process in order to cause the collarette to lay flat. Accordingly, current practice is to cover the raw edge by sewing a tape stripe over the seam. However, this technique requires a separate sewing operation be performed which adds cost and increases the opportunity for producing "seconds".

One type of collar edge construction for a knitted garment which does not require this second sewing operation is disclosed in U.S. Patent No. 5,070,542, issued to LaVelle et al. The construction includes a garment body provided with a finished lower edge and sleeves suitably attached opposite side of the upper end of the garment body. The body is cut away in the usual manner at its upper extremity to form a neck opening. The neck opening is framed by a strip of collarette material which is folded longitudinally to form inner and outer layers. The lower portion of the outer layer is folded inwardly to form a folded portion. The lower edge of the inner layer is also folded to form a second folded portion. At least two parallel lines of stitching pass through the lower portions of the collarette strip and the body fabric to complete the assembly.

Because both edges of the collarette are folded inwardly, no raw edges show. The resulting construction is durable, has a natural tendency to lay flat, and provides an attractive finish in the neck of the garment without the need for a tape strip since there are no exposed raw edges.

While this construction was the first of its kind, it produces a collar that is conventional in outward appearance to the consumer. Many consumers, however, seek shirts that have a more unique "look". Thus, there remains the need for new and improved collar constructions based on the two-needle concept which provides a collar which is durable, has a natural tendency to lay flat, provides an attractive finish in the neck of the garment, and does not require additional steps in the manufacturing process while, at the same time, provides an unique "look" for the consumer.

SUMMARY OF THE INVENTION

The present invention is directed to a collar edge construction which includes a garment body provided with a finished lower edge and sleeves suitably attached opposite side of the upper end of the garment body. The garment body may be formed from any conventional and suitable material, such as flat knit fabric, jersey, etc. The body is cut away in the usual manner at its upper extremity to form a neck opening. The upper edge portion of the body portion is folded inwardly to form a first fold. A strip of collarette fabric material is formed into a longitudinally extending second fold therein to form inner and outer layers. The inner and outer layers are disposed on the inner face of the body portion so as to have the second fold lie substantially parallel to the folded edge of the body portion. The lower edge portion of the outer layer is folded inwardly upon itself so as to form a third fold extending substantially parallel to the first and second folds.

At least two rows of substantially parallel stitching fix the strip of fabric material to the fabric body portion. The first row of stitching passes successively through the outer layer of the collarette fabric strip, the inner layer of the fabric strip, the inwardly folded portion of the outer layer of the fabric strip, and the fabric body portion. The second row of stitching passes successively through the outer layer of the fabric strip, the inner layer of the fabric strip, the inwardly folded edge portion of the fabric body portion, and the fabric body portion. Because both the edges of the fabric body and the collarette fabric strip are folded inwardly, no raw edges show. The resulting construction is durable, has a natural tendency to lay flat, and provides an attractive finish in the neck of the garment.

Accordingly, one aspect of the present invention is to provide a new and improved edge construction for a garment. The construction includes: a) a fabric body portion having an edge defining an opening, the edge portion being folded inwardly to form a first fold; b) a strip of fabric material having a longitudinally extending second fold therein to form inner and outer layers, the inner and outer layers being disposed on the inner face of the body portion so as to have the second fold lie substantially parallel to the folded edge of the body portion; c) the lower edge portion of the outer layer being folded inwardly upon itself so as to form a third fold extending substantially parallel to the first and second folds; d) a first row of stitching for fixing the strip of fabric material to the fabric body portion, wherein the first row of stitching passes successively through the outer layer of the fabric strip, the inner layer of the fabric strip, the inwardly folded portion of the outer layer of the fabric strip, and the fabric body portion; and e) a second row of stitching adjacent to and substantially parallel to the first row of stitching for fixing the fabric strip of fabric material to the fabric body portion, wherein the second row of stitching passes successively through the outer layer of the fabric strip, the inner layer of the fabric strip, the inwardly folded edge portion of the fabric body portion, and the fabric body portion.

Another aspect of the present invention is to provide a new and improved garment construction. The garment construction includes: a) a body of fabric cut away centrally at the top thereof to form a neck opening, the edge portion being folded inwardly to form a first fold; b) a strip of fabric material having a longitudinally extending second fold therein to form inner and outer layers, the inner and outer layers being disposed on the inner face of the body portion so as to have the second fold lie substantially parallel to the folded edge of the body portion; c) the lower edge portion of the outer layer being folded inwardly upon itself so as to form a third fold extending substantially parallel to the first and second folds; and d) at least two rows of substantially parallel stitching for fixing the strip of fabric material to the fabric body portion, wherein the first row of stitching passes successively through the outer layer of the fabric strip, the inner layer of the fabric strip, the inwardly folded portion of the outer layer of the fabric strip, and the fabric body portion and the second row of stitching passes successively through the outer layer of the fabric strip, the inner layer of the fabric strip, the inwardly folded edge portion of the fabric body portion, and the fabric body portion.

These and other aspects of the present invention will become apparent to those skilled in the art after a reading of the following description of the preferred embodiment when considered with the drawings.

DESCRIPTION OF THE PREFERRED EMBODIMENTS

In the following description, like references characters designate like or corresponding parts throughout the several views. Also in the following description, it is to be understood that such terms as "forward", "rearward", "left", "right", "upwardly", "downwardly", and the like are words of convenience and are not to be construed as limiting terms.

Figure 1:
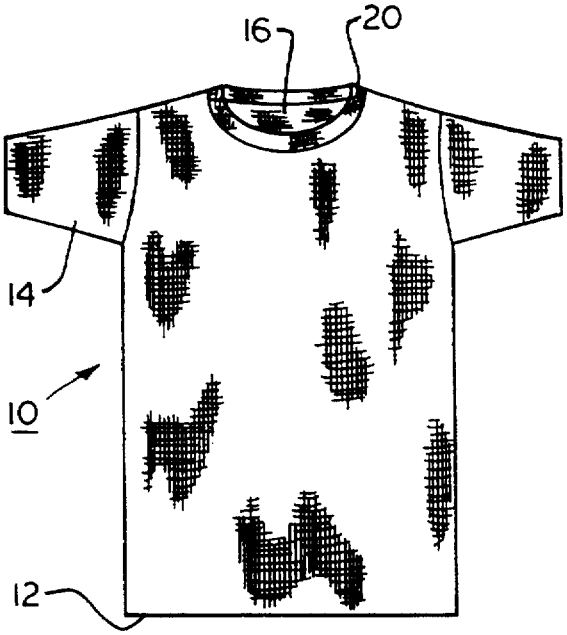
FIG. 1 is a front view of a garment having a neck opening constructed according to the present invention.

Referring now to the drawings in general and FIG. 1 in particular, it will be understood that the illustrations are for the purpose of describing a preferred embodiment of the invention and are not intended to limit the invention thereto. As best seen in FIG. 1, a garment body, generally designated 10, is shown constructed according to the present invention. The garment body may be formed from any conventional and suitable material, such as flat knit fabric, jersey, etc. This material is usually knitted in tubular form and cut into appropriate tubular lengths to form bodies of the individual garments.

The body 10 is provided with a finished lower edge 12 and sleeves 14 are suitably attached opposite side of the upper end of the garment body. The body 10 is cut away in the usual manner at its upper extremity to form a neck opening, generally designated 16. This general manner of construction is conventional.

Figure 2:
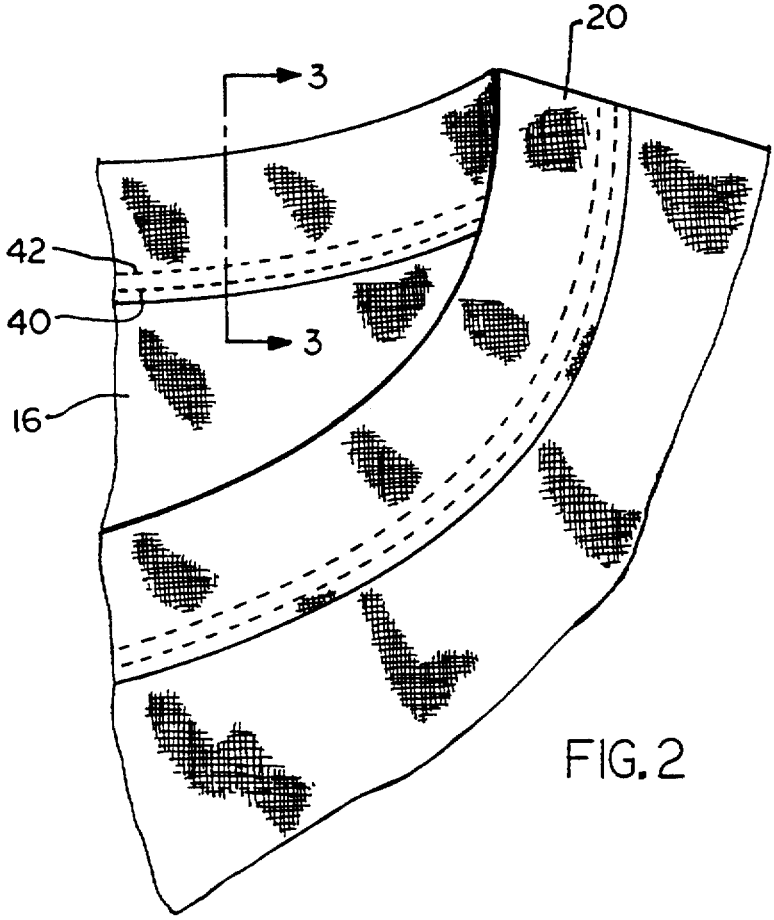
FIG. 2 is an enlarged fragmentary view of the neck portion of the garment shown in FIG. 1.

As best seen in FIG. 2, the neck opening 16 is visibly framed by a strip of collarette material generally designated as 20 which is folded longitudinally to form inner and outer layers 26,28. This collarette material may be of any suitable construction, preferably a 1×1 rib knit fabric being most advantageous in the case of T-shirts.

Figure 3:
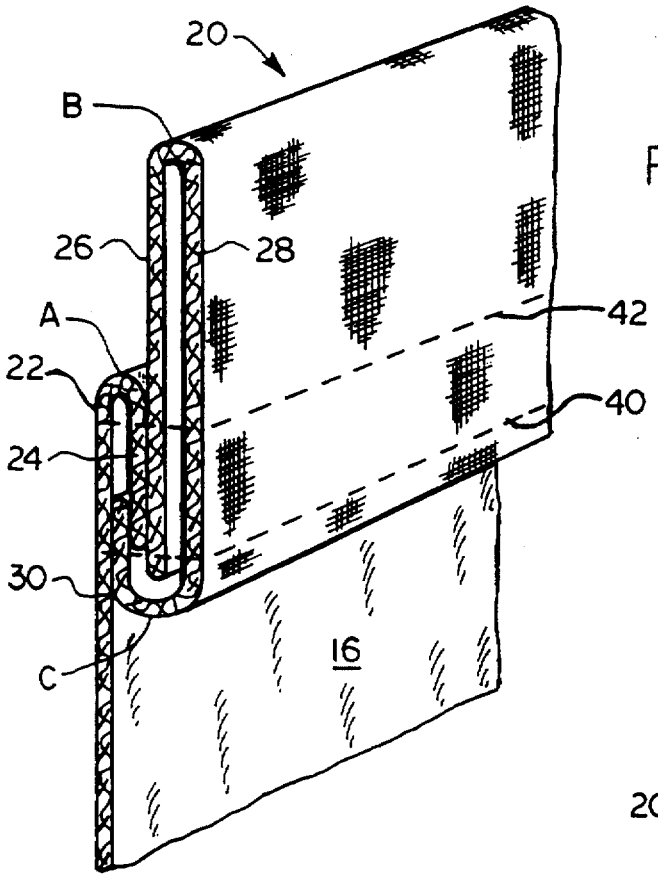
FIG. 3 is an enlarged sectional view of the neck portion of the garment shown in FIGS. 2 and 3, the structure being shown in perspective from the front side of the garment.

Turning to FIG. 3, the upper edge portion 22 of the body portion is folded inwardly to form a first fold A. A strip of collarette fabric material 20 is formed into a longitudinally extending second fold B therein to form inner and outer layers 26,28, respectively. The inner and outer layers are disposed on the inner face of the body portion so as to have the second fold lie substantially parallel to the folded edge 24 of the body portion. The lower edge portion 30 of the outer layer 28 is folded inwardly upon itself so as to form a third fold C extending substantially parallel to the first and second folds. At least two rows 40,42 of substantially parallel stitching fix the strip of fabric material 20 to the fabric body portion. The first row 40 of stitching passes successively through the outer layer 28 of the collarette fabric strip, the inner layer 26 of the fabric strip, the inwardly folded portion 30 of the outer layer 28 of the fabric strip, and the fabric body portion 22. The second row 42 of stitching passes successively through the outer layer 28 of the fabric strip, the inner layer 26 of the fabric strip, the inwardly folded edge portion 24 of the fabric body portion, and the fabric body portion 22. Because both the edges of the fabric body and the collarette fabric strip are folded inwardly, no raw edges show. The resulting construction is durable, has a natural tendency to lay flat, and provides an attractive finish in the neck of the garment.

Figure 4:
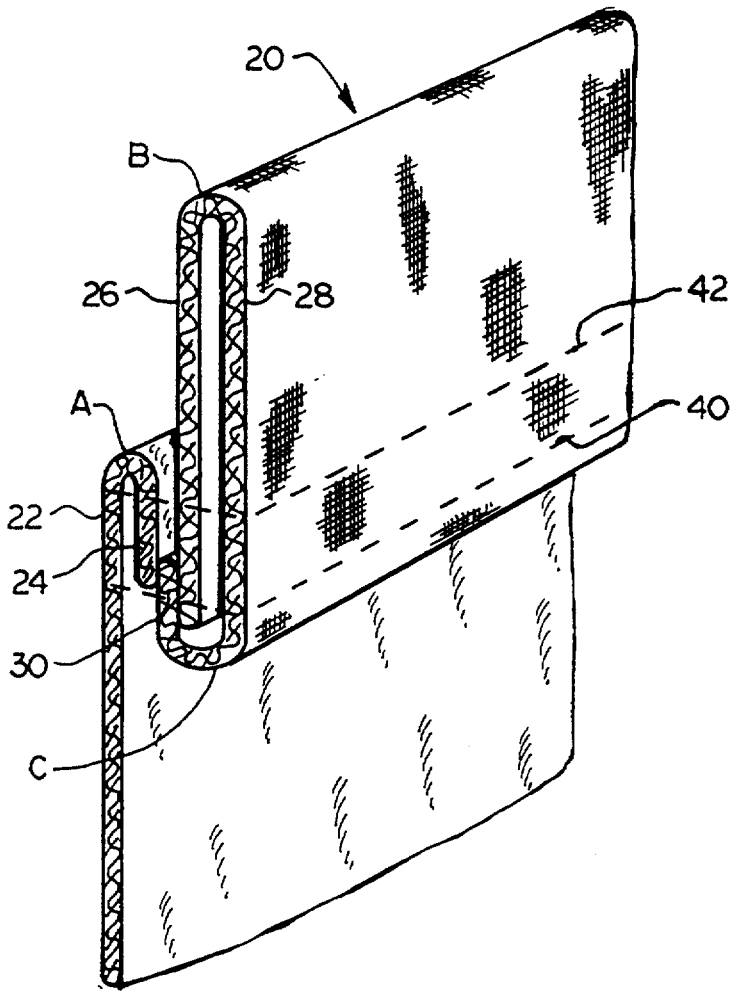
FIG. 4 is an enlarged sectional view of the neck portion of an alternative embodiment of the garment shown in FIGS. 2 and 3, the structure being shown in perspective from the front side of the garment.

Finally, as best seen in FIG. 4, there is shown an alternative embodiment of the edge construction of the present invention. In this embodiment, the lower edge 30 of the outer layer 28 does not overlap the first folded edge portion 24 of the fabric body portion 22. However, since the edge portion 24 does not extend past the lower edge 30 of the outer layer 28, no raw edges show.

In the past it has not been possible to sew two parallel lines of stitching to attach the collarette unless a coverseaming stitch, such as a 406 coverseaming stitch, was used. Thus, two sewing operations would be necessary in order to produce a garment constructed according to the present invention. However, recently experimental sewing machines have been made which permit two parallel, unconnected rows of 401 double locked stitch to be sewn in a single operation. This advancement in sewing technology makes a garment constructed according to the present invention practical for the first time.

In manufacture, the collarette strip 20 can be folded in a single folding machine and applied to the neck and sleeve openings of the body 10 for subsequential sewing. A convenient type of folding machine utilizes two passages which combine the strip and the fabric body in flat form and a folding section for folding the longitudinal folds of the strip. However, various forms of folding machines will be apparent to those skilled in the art and the particular form which may be adapted forms no part of this invention.

While any of several fabrics can be used to form various components of the complete assembly, the collarette strip 20 is preferably formed from a rib knit fabric. In a particular satisfactory T-shirt construction, the body fabric is a flat knit or jersey construction and the collarette strip fabric is a 1×1 rib knit structure.

Garments employing the instant invention have proved to be very satisfactory in tests and in actual wearing and laundering. The multiple layers of body material and collarette material has exhibited exceptional strength and durability as well as a marked resistance to sagging, collar bulging, or other distortions as the fabric as sandwiched keeps the collarette flat while the parallel rows of stitching provide structural integrity. These layers or folds serve also apparently to absorb the strain on seams which normally are caused by use and laundering.

It will be apparent also that the improved functional features have been achieved with an improvement in the outward appearance of the garment. Finally, it will be apparent that the assembly of the present invention can be manufactured without substantial additional expenses and no additional sewing operations are required.

Certain modifications and improvements will occur to those skilled in the art upon reading of the foregoing description. By way of example, the strip of collarette material could be of the seamless "knit-to-size" type which eliminates the shoulder seam passing through the collar and sleeve portions of the shirt. It should be understood that all such modifications and improvements have been deleted herein for the sake of conciseness and readability but are properly within the scope of the following claims.

I claim:

1. A collar edge construction for a garment comprising:

a) a knitted fabric body portion having an edge defining an opening, said edge portion being folded inwardly to form a first fold;

b) a strip of knitted fabric material having a longitudinally extending second fold therein to form inner and outer layers, said inner and outer layers being disposed on an inner face of said body portion so as to have said second fold lie substantially parallel to the folded edge of said body portion;

c) a lower edge portion of said outer layer being folded inwardly upon itself so as to form a third fold extending substantially parallel to said first and second folds;

d) a first row of stitching for fixing said strip of knitted fabric material to said knitted fabric body portion, wherein said first row of stitching passes successively through said outer layer of said knitted fabric strip, said inner layer of said knitted fabric strip, the inwardly folded portion of said outer layer of said knitted fabric strip, and said knitted fabric body portion; and e) a second row of stitching adjacent to and substantially parallel to said first row of stitching for fixing said knitted fabric strip of knitted fabric material to said knitted fabric body portion, wherein said second row of stitching passes successively through said outer layer of said knitted fabric strip, said inner layer of said knitted fabric strip, the inwardly folded edge portion of said knitted fabric body portion, and said knitted fabric body portion.

2. The collar edge construction according to claim 1, wherein said fabric strip is formed of fabric which is relatively elastic in the direction of said second fold.

3. The collar edge construction according to claim 3, wherein said fabric strip is formed from a rib knit fabric.

4. The collar edge construction according to claim 1, wherein said body is formed from a flat knitted fabric and said fabric strip is formed from a 1×1 rib knit fabric.

5. A garment construction comprising:

a) a body of knitted fabric cut away centrally at the top thereof to form a neck opening, said edge portion being folded inwardly to form a first fold;

b) a strip of knitted fabric material having a longitudinally extending second fold therein to form inner and outer layers, said inner and outer layers being disposed on an inner face of said body portion so as to have said second fold lie substantially parallel to the folded edge of said body portion;

c) a lower edge portion of said outer layer being folded inwardly upon itself so as to form a third fold extending substantially parallel to said first and second folds; and d) at least two rows of substantially parallel stitching for fixing said strip of knitted fabric material to said knitted fabric body portion, wherein said first row of stitching passes successively through said outer layer of said knitted fabric strip, said inner layer of said knitted fabric strip, the inwardly folded portion of said outer layer of said knitted fabric strip, and said knitted fabric body portion and said second row of stitching passes successively through said outer layer of said knitted fabric strip, said inner layer of said knitted fabric strip, the inwardly folded edge portion of said knitted fabric body portion, and said knitted fabric body portion.

* * * * *